US005569872A

United States Patent [19]

Gimpel

[11] Patent Number: 5,569,872

[45] Date of Patent: Oct. 29, 1996

[54] MUSICAL PICK-UP DEVICE WITH ISOLATED NOISE CANCELLATION COIL

[75] Inventor: Dudley D. Gimpel, Atascadero, Calif.

[73] Assignee: Ernie Ball, Inc., San Luis Obispo, Calif.

[21] Appl. No.: 309,847

[22] Filed: Sep. 21, 1994

[51] Int. Cl.[6] ..... G10H 3/18

[52] U.S. Cl. ..... 84/728

[58] Field of Search ..... 84/726–728

[56] References Cited

U.S. PATENT DOCUMENTS

| | | | |
|---|---|---|---|
| 955,142 | 4/1910 | Davis . | |
| 1,773,772 | 8/1930 | Berthold . | |
| 2,758,286 | 8/1956 | Wible . | |
| 3,418,603 | 12/1968 | Alexandre . | |
| 3,518,577 | 6/1970 | Baum . | |
| 3,715,673 | 2/1973 | Baum et al. . | |
| 4,151,776 | 5/1979 | Stich . | |
| 4,182,213 | 1/1980 | Iodice . | |
| 4,480,520 | 11/1984 | Gold . | |
| 4,581,974 | 4/1986 | Fender . | |
| 4,581,975 | 4/1986 | Fender . | |
| 4,941,388 | 7/1990 | Hoover et al. . | |
| 5,014,588 | 5/1991 | Omata et al. . | |
| 5,189,241 | 2/1993 | Nakamura . | |
| 5,376,754 | 12/1994 | Stich | 84/728 |
| 5,378,850 | 1/1995 | Tumura | 84/727 |

*Primary Examiner*—Stanley J. Witkowski

*Attorney, Agent, or Firm*—Knobbe, Martens, Olson & Bear

[57] ABSTRACT

The present invention relates to a pick-up device for an electric musical instrument having strings. The pick-up device has a primary coil for sensing the vibration of the strings, and a secondary coil for noise cancellation. The secondary coil is isolated from the primary coil by, for example, an operational amplifier. The primary coil operates in a primary circuit, while the secondary coil operates in a noise cancellation circuit. The impedances of the primary circuit are selected to optimize the frequency response of the primary coil. The impedances of the noise cancellation circuit are selected to match the frequency response of the secondary coil to the frequency response of the primary coil.

32 Claims, 7 Drawing Sheets

MUSICAL PICK-UP DEVICE WITH ISOLATED NOISE CANCELLATION COIL

BACKGROUND OF THE INVENTION

1. Field of the Invention

The present invention pertains to the field of electronic pick-up devices for electric musical instruments. In particular, the present invention pertains to a pick-up device that reduces background hum noise while maintaining high-quality sound reproduction.

2. Description of the Related Art

The present invention relates to a pick-up device for an electric instrument having one or more strings, such as an electric guitar. When a person plays a stringed electric instrument, the strings vibrate with harmonic frequencies. A pickup assembly senses the vibration of the strings and ideally generates an electronic signal containing the same harmonic frequencies without any distortion. The electronic signal is communicated to an amplifier and speaker system to generate sound reflecting the vibration of the strings.

FIG. 1 is a schematic diagram of a first prior art pick-up device 100 having a magnetic coil 102, a first variable resistor 104 and a first audio jack 106. The magnetic coil 102 generates a magnetic field that encompasses the strings of the instrument. The vibration of the strings within the magnetic field causes current to flow through the magnetic coil 102 with a frequency characteristic representing the string vibrations, as is well known to one of skill in the art. Thus, the vibrations of the strings induce an electronic signal within the magnetic coil 102 that is communicated to a first audio signal line 108. The audio signal on the first audio signal line 108 is attenuated by the first variable resistor 104, which implements a volume control. The attenuated audio signal is communicated to the first audio jack 106, and through the first audio jack 106 to an amplifier circuit. The amplifier circuit amplifies the audio signal to a sufficient power level to drive one or more speakers. Thus, the vibrations of the strings of the instrument are converted into corresponding sound at the speaker.

The pick-up device 100 produces excellent sound quality. The harmonic frequencies of the vibrating string, that are within the audible range, are accurately reproduced as sound waves at the speaker. However, in many environments, the pick-up device 100 also produces a humming noise at the speaker. This humming noise is typically caused by the effect of electrical devices within the surrounding environment that operate off the main AC power line. These electrical devices generate electromagnetic fields that also affect the signal generated by the magnetic coil 102. Thus, the audio signal on the first audio signal line 108 has a music component caused by the vibration of the strings and a noise component caused by externally generated electromagnetic fields. Because the main AC power line is typically a 60 Hz signal, the noise component of the signal on the first audio signal line 108 contains a strong 60 Hz frequency component, although other frequencies may also be present.

FIG. 2 illustrates a second prior art pick-up device 150 designed to eliminate the humming noise caused by external electromagnetic fields. The pick-up device 150 has a first primary coil 152 and a first secondary coil 154, each of which generate both a music component and a noise component. The first coils 152, 154 have their magnetic fields reversed from one another, and they are wound in opposite directions. Winding the coils in opposite directions causes the noise components generated by the first coils 152, 154 to have opposite phase, so that the noise components substantially cancel each other. However, the reversed magnetic fields, in addition to the opposite winding directions, causes the music components generated by the first coils 152, 154 to have the same phase. Thus, the music components are added together, while the noise components substantially cancel each other.

Although the pick-up device 150 can be designed to substantially eliminate the background humming noise, the sound quality produced by the hum filtered pick-up device 150 is not as good as the sound quality of the nonfiltered pick-up device 100. The addition of the first secondary coil 154 adversely affects the frequency response of the pick-up device 150, primarily because of the impedance of the first secondary coil 154. The inductance and capacitance, in particular, of the first secondary coil 154 adversely affects the frequency response of the first primary coil 152. Similarly, the inductance and capacitance of the first primary coil 152 adversely affects the frequency response of the first secondary coil 154.

FIG. 3 illustrates a third prior art pick-up device 190 that is described in U.S. Pat. No. 4,581,974, issued to Fender on Apr. 15, 1986. Similar to the pick-up device 150, the pick-up device 190 provides a first coil 172 and a second coil 174 for hum cancellation. The pick-up device 190 also provides some isolation between the two coils 172, 174 to reduce the effect that the impedance of one coil has on the frequency response of the other coil. However, the tone quality produced by the pick-up device 190 is still significantly worse than the tone quality of the nonfiltered pick-up device 100. The frequency response of the two coils 172, 174 is still adversely affected by the impedances surrounding the two coils 172, 174. Also, the music component of the audio signal is subjected to the frequency response of the operational amplifier 170.

SUMMARY OF THE INVENTION

One aspect of the present invention involves a pick-up circuit for an electric musical instrument having one or more strings. The pickup circuit comprises a first coil, a second coil, and an isolation circuit. The first coil is responsive to the vibration of one or more of the strings to produce a first electronic signal. The first coil is further responsive to one or more stimuli in addition to the vibration of the strings. The second coil is responsive to one or more of the additional stimuli to produce a second electronic signal. The second signal is combined with the first signal. The isolation circuit is connected between the second coil and the first coil and configured to isolate the first and second coil and combine the first and second signals to remove the portion of the first signal responsive to the one or more stimuli.

Another aspect of the present invention involves a second pickup circuit for an electric musical instrument having one or more strings. The second pickup circuit comprises an output terminal, a first coil and a second coil. The first coil is positioned to sense the vibration of one or more of the strings. The first coil is responsive to the vibration of one or more of the strings to produce a first electronic signal in response thereto. The first coil is also responsive to one or more stimuli in addition to the vibration of the strings such that the first electronic signal represents the vibration and the one or more stimuli. The first coil is coupled to the output terminal and provides a second electronic signal to the output terminal. The second coil is responsive to one or more of the additional stimuli to produce a third electronic signal. The third electronic signal is representative of the one or more stimuli. The second coil is interfaced with the first coil so that the impedance of the second coil is isolated from the first coil. The first signal is combined with the third signal to produce the second signal such that the second signal is exclusive of the one or more stimuli.

Another aspect of the present invention involves a third pickup circuit for an electric musical instrument having one or more strings. The third pickup circuit comprises a first circuit, a second circuit, and an isolation circuit. The second circuit is coupled via the isolation circuit to the first circuit. The first circuit comprises a first coil and one or more first electronic impedance components coupled to the first coil. The first coil is responsive to the vibration of one or more of the strings to produce a first electronic signal. The first coil is further responsive to one or more electromagnetic fields. The first electronic impedance components have impedances selected to optimize the frequency response of the first coil. The second circuit comprises a second coil and one or more second electronic impedance components. The second coil is responsive to one or more of the electromagnetic fields to produce a second electronic signal. The second signal is combined with the first signal via the isolation circuit. The second electronic impedance components have impedances selected to substantially match the frequency response of the second coil to the frequency response of the first coil. The isolation circuit is configured to isolate the first circuit from the second circuit.

Another aspect of the present invention involves a fourth pickup circuit for an electric musical instrument having one or more strings. The fourth pickup circuit comprises a first coil, a second coil, and a buffer. The first coil is responsive to the vibration of one or more of the strings to produce a first electronic signal representative of the vibration. The first coil is also responsive to one or more electromagnetic fields. The second coil is responsive to one or more of the electromagnetic fields to produce a second electronic signal. The second electronic signal is coupled to an input of the buffer. The buffer is responsive to the second electronic signal to produce a buffered signal at an output of the buffer. The buffer is connected to combine the first signal and the buffered signal.

Another aspect of the present invention involves a fifth pickup circuit for an electric musical instrument having one or more strings. The fifth pickup circuit comprises a first coil, a second coil, means for isolating the second coil from the first coil, and means for combining the second signal with the first signal for noise cancellation. The first coil is responsive to the vibration of one or more of the strings to produce a first electronic signal. The first coil is also responsive to one or more electromagnetic fields to produce noise in the first signal. The second coil is responsive to one or more of the electromagnetic fields to produce a second electronic signal representative of the noise.

DETAILED DESCRIPTION OF THE PREFERRED EMBODIMENT

Figure 4:
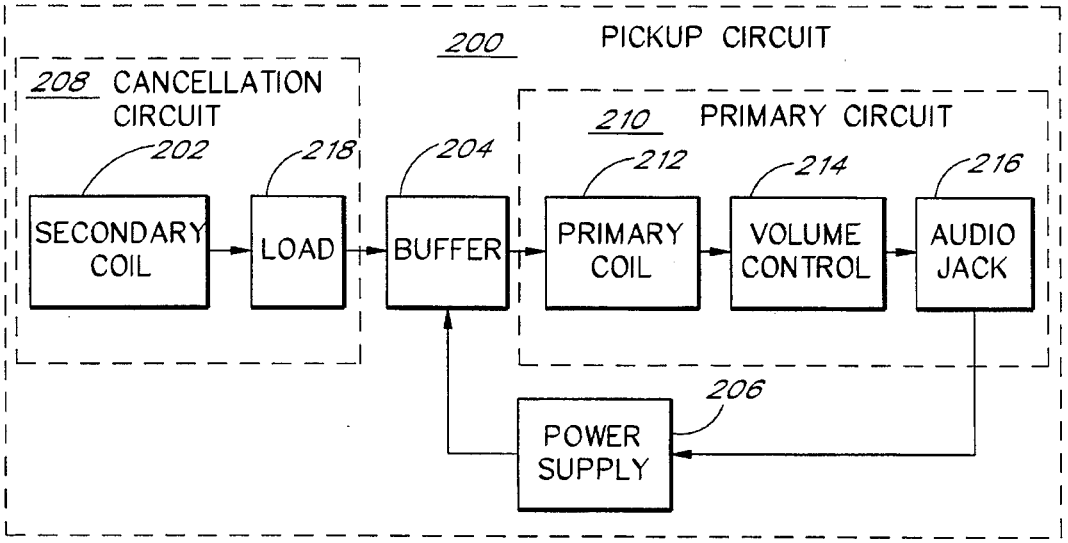
FIG. 4 is a functional block diagram of a preferred embodiment of the musical pick-up device of the present invention.

FIG. 4 illustrates a functional block diagram of a preferred embodiment of the musical pick-up device of the present invention. A pick-up device 200 comprises a cancellation circuit 208, an isolation circuit 204, a primary circuit 210, and a power supply 206. The cancellation circuit 208 comprises a secondary coil 202 and a load 218. The primary circuit 210 comprises a primary coil 212, a volume control 214, and an audio jack 216. In the present embodiment, the isolation circuit 204 comprises a buffer.

Generally, the power supply 206 provides electrical power to the buffer 204. The buffer 204 preferably comprises one or more active electronic components. The buffer 204 isolates the cancellation circuit 208 from the primary circuit 210. The primary coil 212 generates an audio signal comprising a music component and, whenever noise is present, a noise component. The primary circuit 210 is generally designed to optimize the frequency response of the primary coil 212. The secondary coil 202 generates an audio signal representative of the noise component. The cancellation circuit 208 is generally designed to achieve a frequency response from the secondary coil 202 that matches the frequency response of the primary coil 212. The buffer 204 communicates the signal from the secondary coil 202 to the primary circuit 210, so that the respective noise components generated by the primary coil 212 and the secondary coil 202 cancel each other. The signal generated by the primary coil 212 is attenuated at the volume control 214 before being communicated to the audio jack 216. The secondary coil 202 may also generate a music component signal that is communicated to the primary circuit 210 by the buffer 204, so that the respective music components generated by the primary coil 212 and the secondary coil 202 are additive.

For each of the FIGS. 5 to 9, components, terminals, and signal lines in one figure generally correspond to components, terminals, and signal lines in other figures for which the last two numerical digits of the respective reference numbers are the same. In most instances, the characteristics and functions of the corresponding components, terminals and signal lines are substantially the same.

Figure 5:
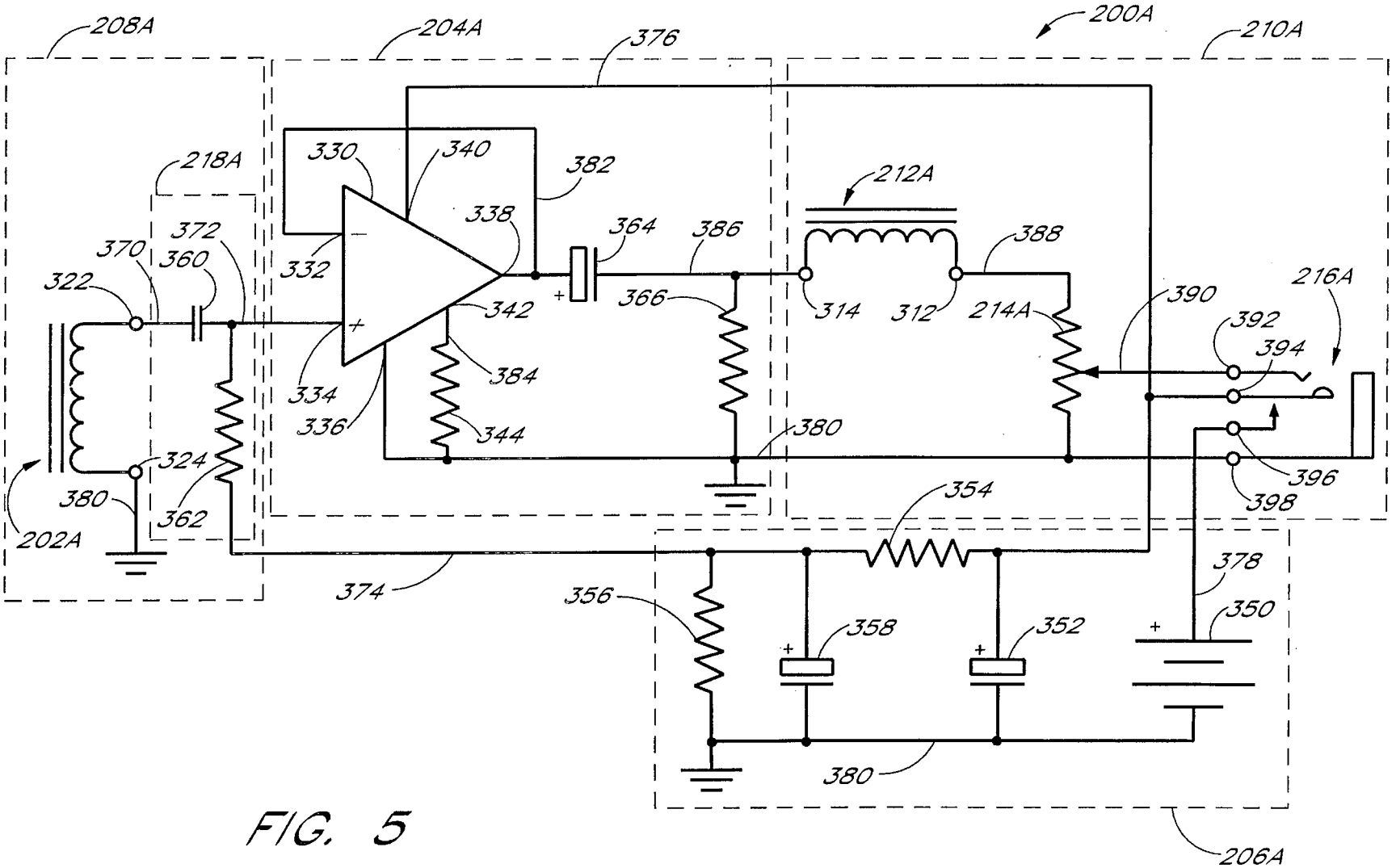
FIG. 5 is a schematic diagram of a first preferred embodiment of the musical pick-up device of the present invention.

FIG. 5 is a schematic diagram of a first preferred embodiment pick-up device 200A of the pick-up device 200. The first pick-up device 200A comprises a first embodiment cancellation circuit 208A, a first embodiment buffer 204A, a first embodiment power supply 206A, a first embodiment primary circuit 210A, and a first coupling capacitor 364. The first cancellation circuit 208A comprises a secondary coil 202A and a load 218A. The load 218A comprises a second coupling capacitor 360 and a load resistor 362. The first buffer 204A comprises an operational amplifier (op amp) 330 and a programming resistor 344. The first power supply 206A comprises a battery 350, a first filter capacitor 352, a first voltage divider resistor 354, a second voltage divider resistor 356, and a second filter capacitor 358. The first primary circuit 210A comprises a primary coil 212A, a volume control 214A, an audio jack 216A, and an op amp load resistor 366.

The primary coil 212A comprises a first primary coil terminal 312 and a second primary coil terminal 314. The secondary coil 202A comprises a first secondary terminal 322 and a second secondary coil terminal 324. The audio jack 216A comprises a first audio jack terminal 392, a second audio jack terminal 394, a third audio jack terminal 396, and a fourth audio jack terminal 398. The op amp 330 comprises an inverting input 332, a noninverting input 334, a negative supply voltage input 336, an output 338, a positive supply voltage input 340, and a quiescent current set input 342.

The op amp 330 preferably comprises an LM4250 op amp, for example, manufactured by National Semiconductor Corporation, although other op amps can be used. The LM4250 op amp is preferred because of its low power consumption. The primary coil 212A and the secondary coil 202A are preferably matched, so that the two coils 212A, 202A have substantially the same frequency response. For example, the two coils 212A, 202A preferably have substantially the same physical dimensions, the same gauge wire, and the same number of turns. The battery 350 preferably comprises a 9-volt battery. The first filter capacitor 352 preferably comprises a 1 microfarad capacitor. The first voltage divider resistor 354 and the second voltage divider resistor 356 preferably comprise 2.2 megaohm resistors. The second filter capacitor 358 preferably comprises a 1 microfarad capacitor. The second coupling capacitor 360 preferably comprises a 0.1 microfarad capacitor. The load resistor 362 preferably comprises a 250 kiloohm resistor. The programming resistor 344 preferably comprises a 1.5 megaohm resistor. The first coupling capacitor 364 preferably comprises a 10 microfarad capacitor. The op amp load resistor 366 preferably comprises a 56 kiloohm resistor. The volume control 214A preferably comprises approximately a 250 kiloohm variable resistor, although the resistance of the volume control 214A may be anywhere between 100 kiloohms and 1 megaohm for high impedance coils, or as low as approximately 1 kiloohm for lower impedance coils. Other resistors and capacitors can also be used in the first embodiment pick-up device 200A depending on the type of op amp 330 and coils 212A, 202A that are used. The resistors and capacitors can also be varied to alter the frequency response of the first embodiment pick-up device 200A, within the guidelines described herein.

A positive terminal of the battery 350 is connected to the third terminal 396 of the audio jack 216A by a first supply voltage line 378. A negative terminal of the battery 350 is connected to a ground line 380. The second terminal 394 of the audio jack 216A is connected to a second supply voltage line 376. The second supply voltage line 376 is connected to a first terminal of the first voltage divider resistor 354 and to a positive terminal of the first filter capacitor 352. A negative terminal of the first filter capacitor 352 is connected to the ground line 380. A second terminal of the first voltage divider resistor 354 is connected to an offset voltage line 374. The offset voltage line 374 is also connected to a positive terminal of the second filter capacitor 358 and to a first terminal of the second voltage divider resistor 356. A negative terminal of the second filter capacitor 358 and a second terminal of the second voltage divider resistor 356 are connected to the ground line 380.

The second terminal 324 of the secondary coil 202A is connected to the ground line 380. The first terminal 322 of the secondary coil 202A is connected to a first terminal of the second coupling capacitor 360 by a hum signal line 370. A second terminal of the second coupling capacitor 360 is connected to an offset hum signal line 372. The offset hum signal line 372 is also connected to the noninverting input 334 of the op amp 330 and to a first terminal of the load resistor 362. A second terminal of the load resistor 362 is connected to the offset voltage line 374. The negative supply voltage input 336 of the op amp 330 is connected to the ground line 380. The quiescent current set input 342 of the op amp 330 is connected to a quiescent current set line 384. The quiescent current set line 384 is also connected to a first terminal of the programming resistor 344. A second terminal of the programming resistor 344 is connected to the ground line 380. The positive supply voltage input 340 of the op amp 330 is connected to the second supply voltage line 376. The output 338 of the op amp 330 is connected to the inverting input 332 of the op amp 330 by a negative feedback line 382. The negative feedback line 382 is also connected to a positive terminal of the first coupling capacitor 364. A negative terminal of the first coupling capacitor 364 is connected to an isolated hum signal line 386.

The isolated hum signal line 386 is also connected to a first terminal of the op amp load resistor 366 and to the second terminal 314 of the primary coil 212A. A second terminal of the op amp load resistor 366 is connected to the ground line 380. The first terminal 312 of the primary coil 212A is connected to a first input terminal of the variable resistor 214A by an audio signal line 388. A second input terminal of the variable resistor 214A is connected to the ground line 380. A variable output terminal of the variable resistor 214A is connected to the first terminal 392 of the audio jack 216A by a modulated audio signal line 390. The fourth terminal 398 of the audio jack 216A is connected to the ground line 380.

When an audio plug (not shown) is inserted into the audio jack 216A, the second terminal 394 of the audio jack 216A contacts the third terminal 396 of the audio jack 216A. Thus, the positive terminal of the battery 350 is connected to the second supply voltage line 376 through the first supply voltage line 378, the third audio jack terminal 396, and the second audio jack terminal 394. As a result, the electrical power from the battery 350 is only supplied to the op amp 330 when an audio plug is plugged into the audio jack 216A. The first filter capacitor 352 filters noise between the second supply voltage line 376 and the ground line 380. The first voltage divider resistor 354 and the second voltage divider resistor 356 combine to form a voltage divider between the second supply voltage line 376 and the ground line 380. In the preferred embodiment, the battery 350 comprises a 9-volt battery and the first and second voltage divider resistors 354 and 356 each have the same resistance. Thus, the voltage at the offset voltage line 374 is approximately 4.5 volts. The second filter capacitor 358 filters noise between the offset voltage line 374 and the ground line 380.

External electromagnetic fields induce a voltage across the secondary coil 202A. At least a portion of this voltage represents noise that will also be induced on the primary coil 212A. The voltage induced across the secondary coil 202A is applied to the hum signal line 370. The second coupling capacitor 360 and the load resistor 362 form an RC network to block any DC component of the offset hum signal line 372 from reaching the signal on the hum signal line 370. The signal on the offset hum signal line 372 substantially comprises the sum of an AC signal on the hum signal line 370 and the DC signal on the offset voltage line 374. In other words, the signal on the offset hum signal line 372 comprises the AC signal induced on the secondary coil 202A, offset by a constant 4.5 volts.

The AC signal on the offset hum signal line 372 is offset by approximately 4.5 volts to minimize the distortion introduced by the op amp 330. The transfer characteristics of the op amp 330 are most nearly linear at a voltage that is midway between the voltage at the positive supply voltage input 340 and at the negative supply voltage input 336. The positive supply voltage input 340 is connected to the positive terminal of the 9-volt battery 350, while the negative supply voltage input 336 is connected to the ground line 380. Thus, the 4.5-volt offset of the offset hum signal line 372 is approximately midway between the positive supply voltage input 340 and the negative supply voltage input 336. The programming resistor 344 programs several of the electrical characteristics of the op amp 330, as is well known in the art.

The negative feedback line 382 connects the output 338 of the op amp 330 to the inverting input 332. This connection forms a voltage follower or a buffer amplifier configuration. The signal at the output 338 has substantially the same magnitude and phase as the signal at the noninverting input 334. Thus, the AC voltage induced in the secondary coil 202A, along with the 4.5 volt DC offset, is transferred to the output 338 of the op amp 330. The first coupling capacitor 364 and the op amp load resistor 366 form an RC network to substantially eliminate the 4.5 volt DC component of the signal at the output 338. Thus, the signal on the isolated hum signal line 386 is substantially the same as the AC signal induced by external noise at the secondary coil 202A.

Figure 8:
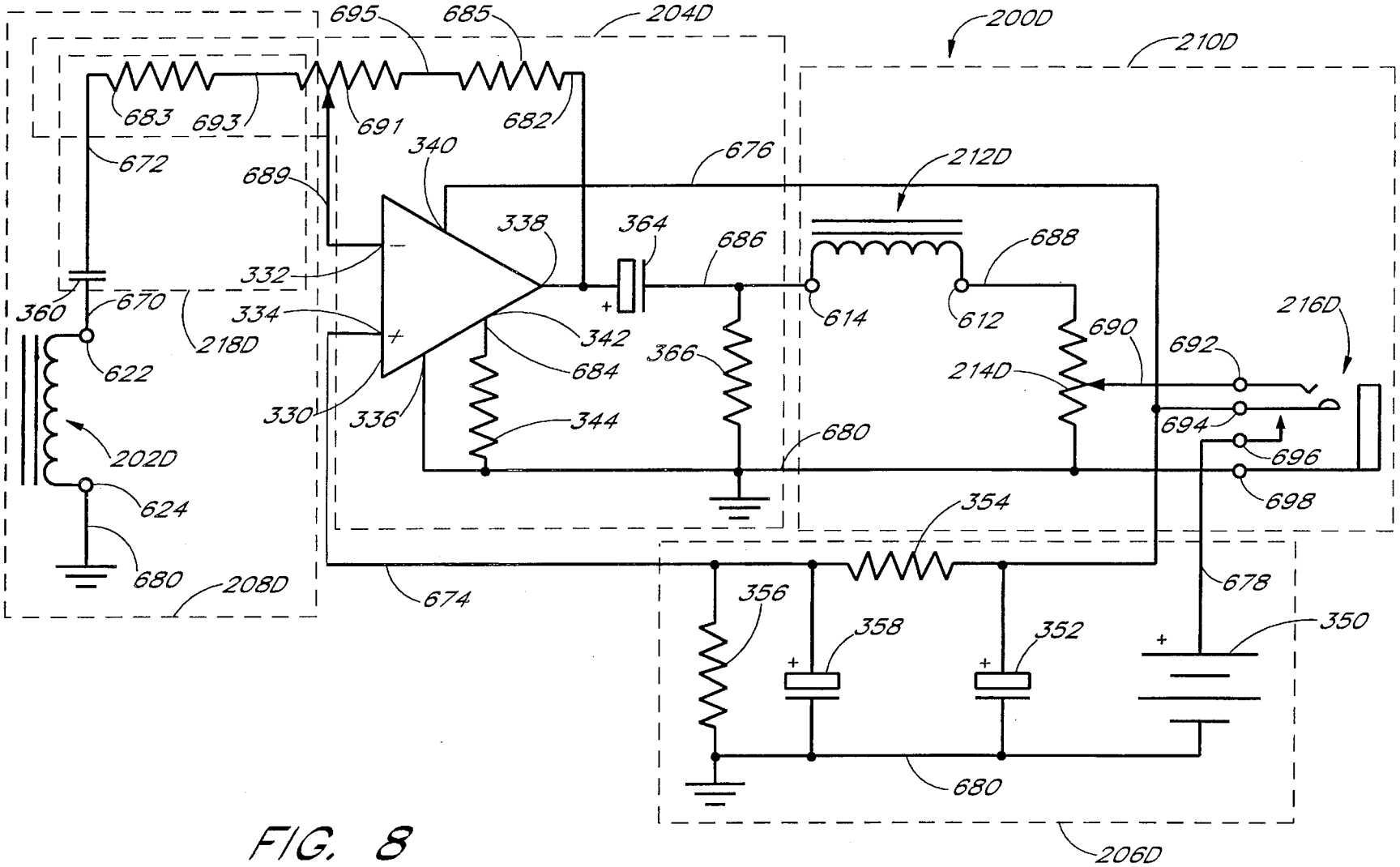
FIG. 8 is a schematic diagram of a fourth preferred embodiment of the musical pick-up device of the present invention.

The vibration of the string of the electrical instrument induces a voltage across the primary coil 212A. In addition, external electromagnetic noise may induce a voltage across the primary coil 212A. Thus, the primary coil 212A generates a signal that may comprise both a music component and a noise component. As described above, the secondary coil 202A also generates a noise component. In the first pick-up device 200A, the secondary coil 202A is wound in an opposite direction from the primary coil 212A, so that the phase of the noise component generated by the secondary coil 202A is opposite to the phase of the noise component generated by the primary coil 212A. The first buffer 204A passes the noise component from the secondary coil 202A through to the isolated hum signal line 386 without substantially affecting the phase of the signal, because, as described above, the first buffer 204A comprises a noninverting voltage follower. As a result, the voltage induced at the primary coil 212A by the external noise is substantially canceled by the noise component from the secondary coil 202A at the isolated hum signal line 386. Thus, the signal at the audio signal line 388 consists of the voltage induced at the primary coil 212A, but with the effects of external noise substantially canceled. The cancellation between the noise components generated by the primary coil 212A and the secondary coil 202A can alternatively be accomplished by using an inverting buffer, while winding the secondary coil 202A in the same direction as the primary coil 212A. FIG. 8 illustrates an embodiment of the present invention utilizing an inverting buffer.

The secondary coil 202A may be placed in a remote location relative to the strings to avoid generating a music component. Alternatively, the secondary coil 202A may be placed so as to generate a music component. In this case, the op amp 330 passes the music component through to the first embodiment primary circuit 210A, along with the noise component. The music components from the two coils 212A, 202A are added together at the isolated hum signal line 386.

Figure 1:
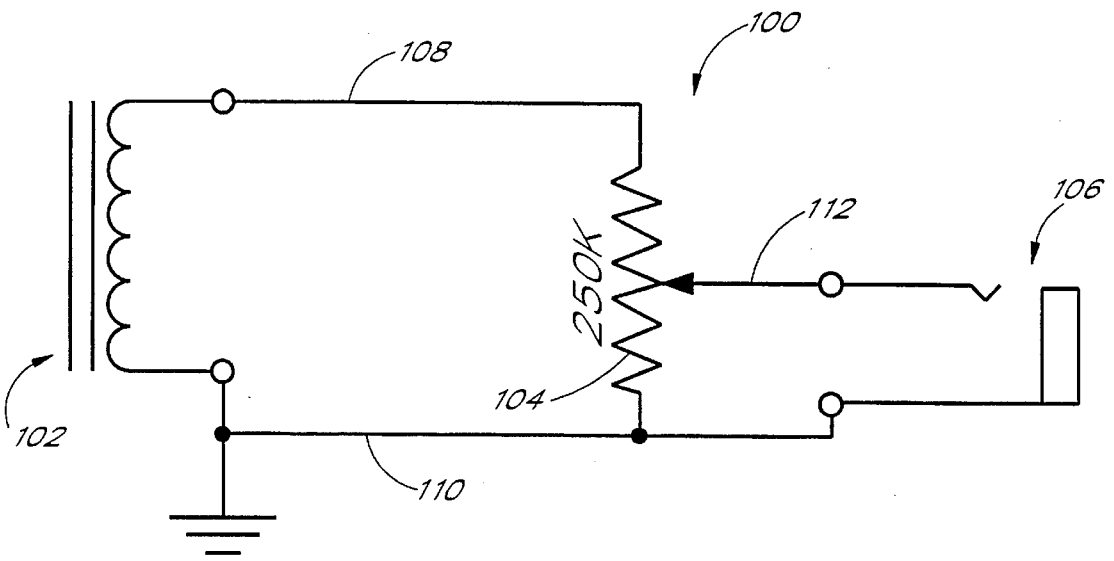
FIG. 1 (PRIOR ART)
FIG. 1 is a schematic diagram of a first prior art pick-up device, including a single magnetic coil.
Figure 2:
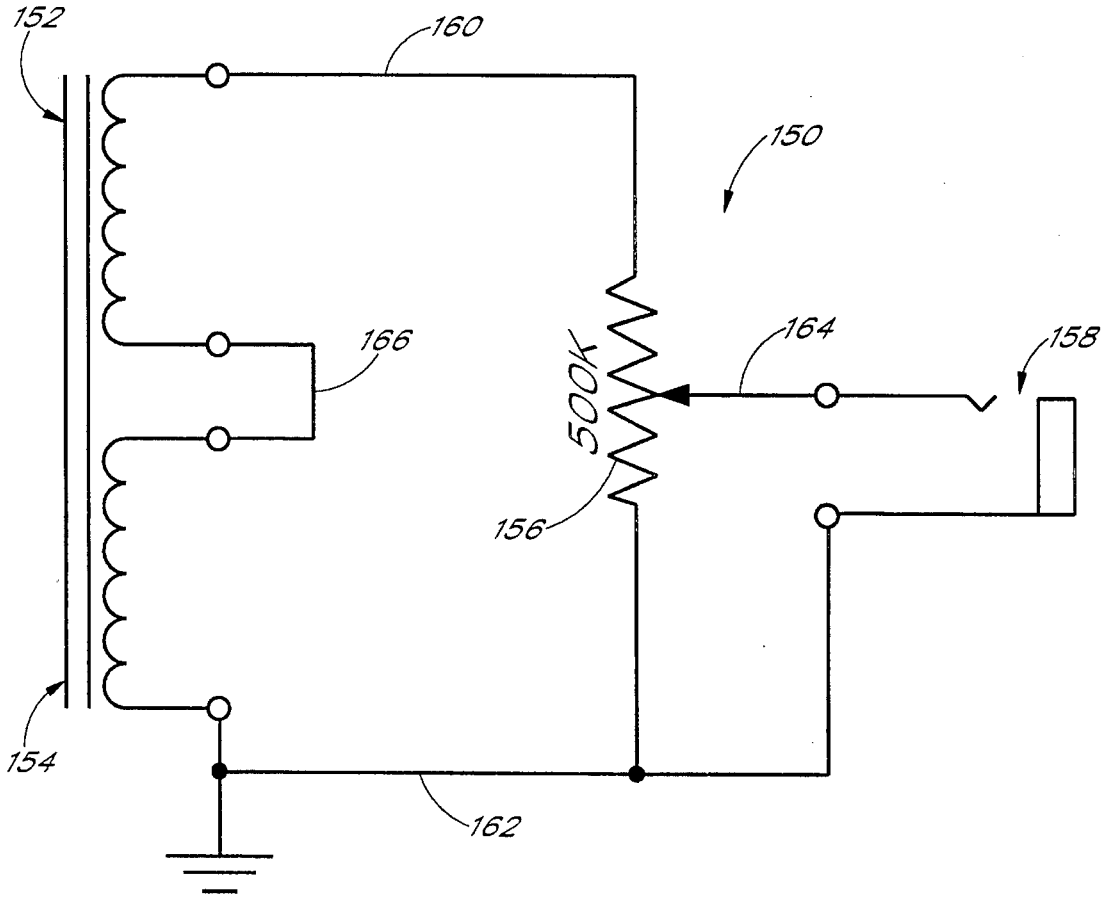
FIG. 2 (PRIOR ART)
FIG. 2 is a schematic diagram of a second prior art pick-up device, including a pair of magnetic coils.

Similar to the designs of FIGS. 1 and 2, the variable resistor 214A generally attenuates the signal on the audio signal line 388 to generate an attenuated audio signal on the attenuated audio signal line 390. The attenuated audio signal is provided, along with a ground signal, to the audio jack 216A.

The first embodiment pick-up device 200A has substantially the same advantageous noise cancellation characteristics as the hum filtered pick-up device 150 of FIG. 2, while achieving substantially the same tone quality as the single coil pick-up device 100 of FIG. 1. Several design features contribute to the improved tone quality of the first embodiment pick-up device 200A, over prior art pick-up devices that provide hum cancellation.

For example, the impedances of the first embodiment primary circuit 210A, in which the primary coil 212A operates, generally do not adversely affect the tone quality produced by the primary coil 212A. In the pick-up device 150, the inductance and capacitance of the first secondary coil 154 adversely affect the tone quality produced by the first primary coil 152. The first embodiment pick-up device 200A avoids this problem by isolating the primary coil 212A from the secondary coil 202A. Specifically, the op amp 330 isolates the secondary coil 202A from the primary coil 212A, so that the tone quality produced by the primary coil 212A is not adversely affected by the inductance and capacitance of the secondary coil 202A. A well known characteristic of op amps is that the output is substantially isolated from the inputs. In particular, any impedance at an input of an op amp does not significantly affect the circuitry connected to the output of the op amp. In fact, the output impedance of an op amp is generally equivalent to a 50 to 100 ohm resistor, regardless of the impedance of the circuitry connected to the inputs of the op amp. Thus, the output 338 of the op amp 330 is substantially isolated from the impedance at the noninverting input 334. As a result, the primary coil 212A is substantially isolated from the inductance and capacitance of the secondary coil 202A.

Preferably, the impedances of the first embodiment primary circuit 210A are substantially the same as the impedances of the pick-up device 100. As depicted in FIG. 1, the magnetic coil 102 is connected between the first audio signal line 108 and ground. The first audio signal line 108 is connected to the first variable resistor 104. Typically, the first variable resistor 104 has a relatively high resistance, such as approximately 250 kiloohms. Thus, the magnetic coil 102 is connected between ground and a relatively high resistance, where a variable portion of the high resistance is connected in parallel with the impedance of the amplifier circuit.

As illustrated in FIG. 5, the impedances of the first embodiment primary circuit 210A exhibit substantially the same characteristics as the impedances of the pick-up device 100 of FIG. 1. The first terminal 312 of the primary coil 212A is connected to the variable resistor 214A, which preferably has the same resistance as the first variable resistor 104. Also, the variable resistor 214A is connected to the amplifier circuit in the same manner that the first variable resistor 104 is connected to the amplifier circuit. Thus, if the second terminal 314 of the primary coil 212A were connected directly to ground, the impedances of the first embodiment primary circuit 210A would be the same as the impedances of the pick-up device 100. The second primary coil terminal 314 is actually connected to virtual ground through the op amp load resistor 366 and the output 338 of the op amp 330. The output 338 of the op amp 330 typically has an impedance of between 50 and 100 ohms. Thus, the combined impedance of the output 338 and the op amp load resistor 366 is also between 50 and 100 ohms. The impedance of the primary coil 212A is typically much greater than 100 ohms, so that the effect of the small resistance between the second primary coil terminal 314 and ground is substantially negligible. Accordingly, the second terminal 314 of the primary coil 212A is effectively connected to ground. Thus, the impedances surrounding the primary coil 212A are substantially the same as the impedances surrounding the magnetic coil 102 for the pickup in FIG. 1, and so the primary coil 212A produces substantially the same tone quality as the magnetic coil 102.

As described above, the isolation of the secondary coil 202A from the primary coil 212A ensures that the inductance and capacitance of the secondary coil 202A do not affect adversely the frequency response of the primary coil 212A. The same isolation also ensures that the inductance and capacitance of the primary coil 212A do not affect adversely the frequency response of the secondary coil 202A. If the frequency response of the secondary coil 202A were affected adversely by surrounding impedances, the noise component generated by the secondary coil 202A would not match the noise component generated by the primary coil 212A, which would reduce the effectiveness of the cancellation. As illustrated in FIG. 5, the values of the load resistor 362 and the second coupling capacitor 360 are selected so that the impedances surrounding the secondary coil 202A are similar to the impedances surrounding the primary coil 212A. In particular, the value of the load resistor 362 is selected so that the combined resistance of the load resistor 362 and the noninverting input 334 of the operational amplifier 330 is approximately equal to the resistance of the variable resistor 214A. This impedance matching between the first embodiment cancellation circuit 208A and the first embodiment primary circuit 210A causes the frequency response of the secondary coil 202A to substantially match the frequency response of the primary coil 212A, which improves noise cancellation. Preferably, the primary coil 212A and the secondary coil 202A are selected so that the electromagnetic characteristics of the two coils are similar to further improve noise cancellation.

Figure 3:
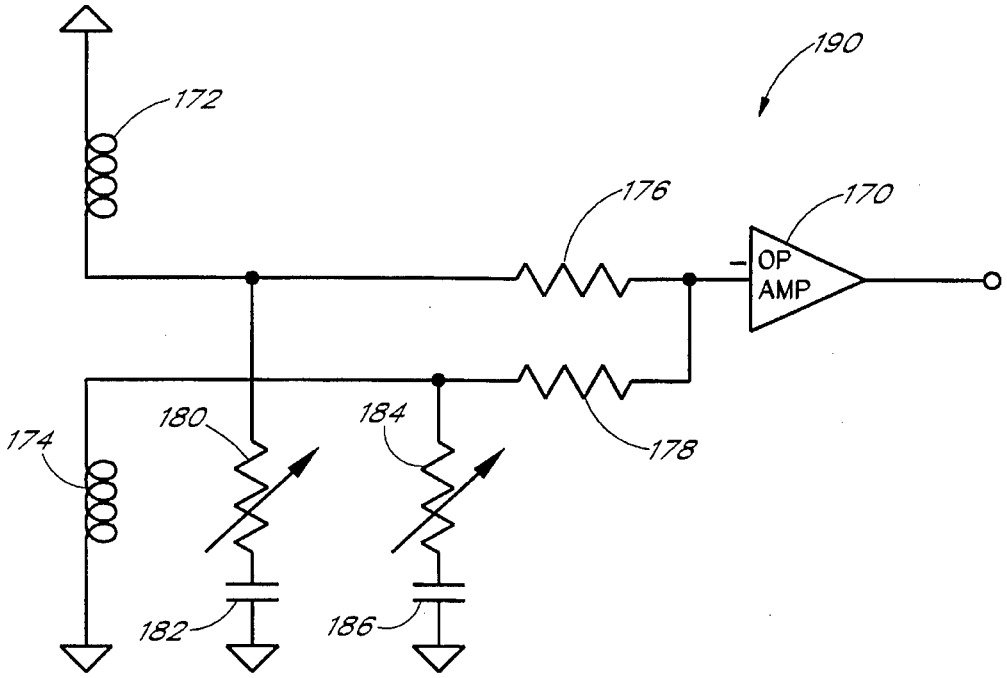
FIG. 3 (PRIOR ART)
FIG. 3 is a schematic diagram of a third prior art pick-up device, also including a pair of magnetic coils.

Another advantageous feature of the first embodiment pick-up device 200A is that the primary coil 212A drives the audio signal at the audio jack 216A, so that the music component produced by the primary coil 212A only passes through the variable resistor 214A before reaching the audio jack 216A. In particular, the music component does not pass through the op amp 330, so the primary coil 212A behaves more like a coil in a passive circuit, such as the circuit of FIG. 1. If the audio signal at the audio jack 216A were driven by the op amp 330, such as in the pick-up device 190 of FIG. 3, the frequency response of the op amp 330 would impact the tone quality of the audio signal. In addition, the op amp 330 would create noise on the audio signal.

Figure 6:
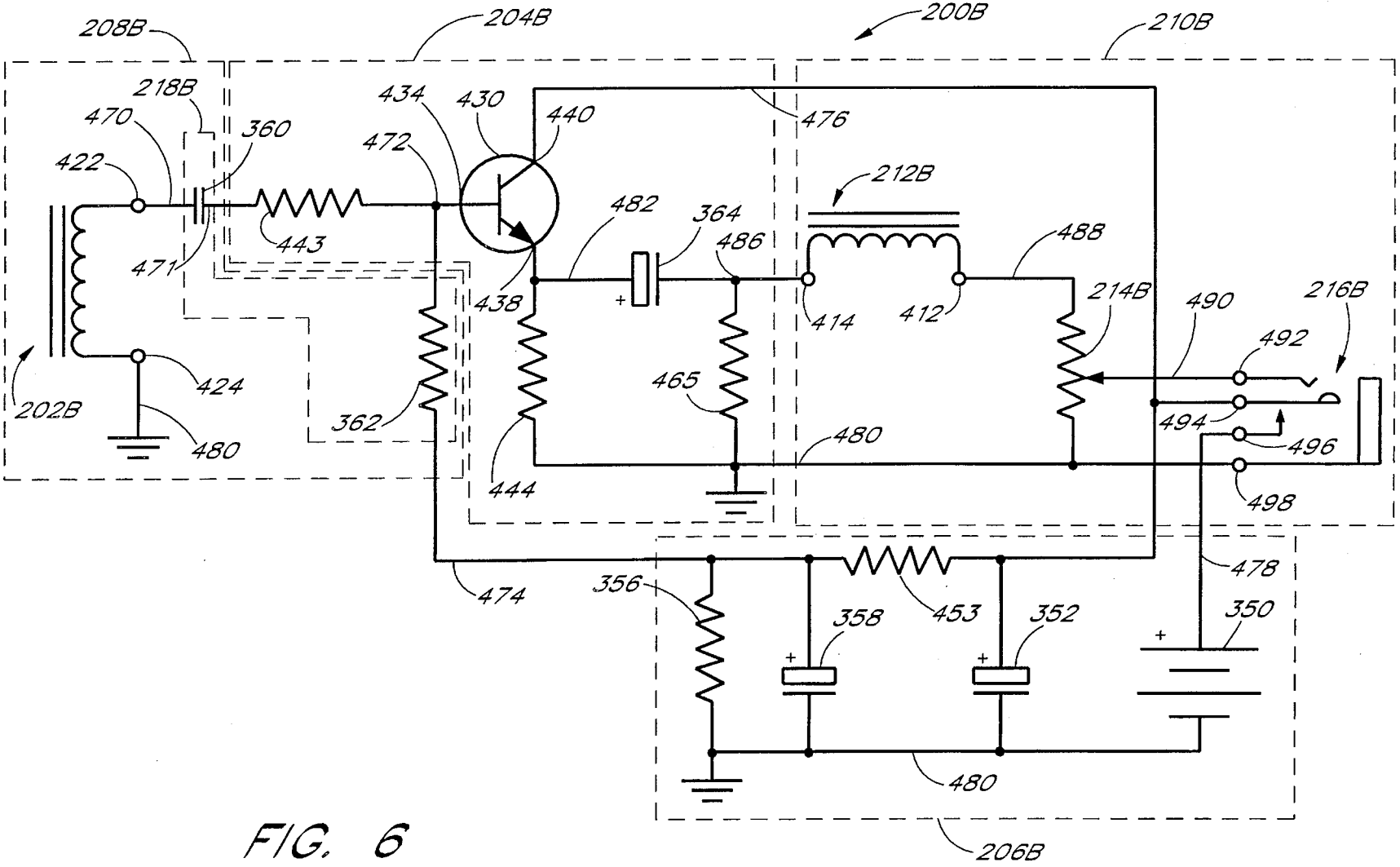
FIG. 6 is a schematic diagram of a second preferred embodiment of the musical pick-up device of the present invention.

FIG. 6 is a schematic diagram of a second preferred embodiment pick-up device 200B of the pick-up device 200. The second pick-up device 200B is substantially the same as the first embodiment pick-up device 200A, except that a second embodiment buffer 204B differs from the first embodiment buffer 204A. The second embodiment buffer 204B comprises a transistor 430, a first biasing resistor 443, and a second biasing resistor 444. The transistor 430 preferably comprises a ZTX 109 transistor, for example, manufactured by Zetex. The first biasing resistor 443 and the second biasing resistor 444 preferably comprise 10 kiloohm resistors. Also, a transistor load resistor 465 preferably has a resistance of 100 kiloohms and a third voltage divider resistor 453 preferably has a resistance of 1.5 megaohms. Many other transistors can also be used, and the values of the first biasing resistor 443, the second biasing resistor 444, the third voltage divider resistor 453, and the transistor load resistor 465 can be varied.

The operation of the second embodiment pick-up device 200B is substantially the same as the operation of the first embodiment pick-up device 200A. Also, the second pick-up device 200B achieves substantially the same advantages as the first pick-up device 200A, except the isolation provided by the transistor 430 is not as good as the isolation provided by the op amp 330. The second pick-up device 200B may be advantageous in some applications because the transistor 430 is preferably smaller and less expensive than the op amp 330, and the transistor 430preferably produces less circuit noise (hiss) than the op amp 330.

Figure 7:
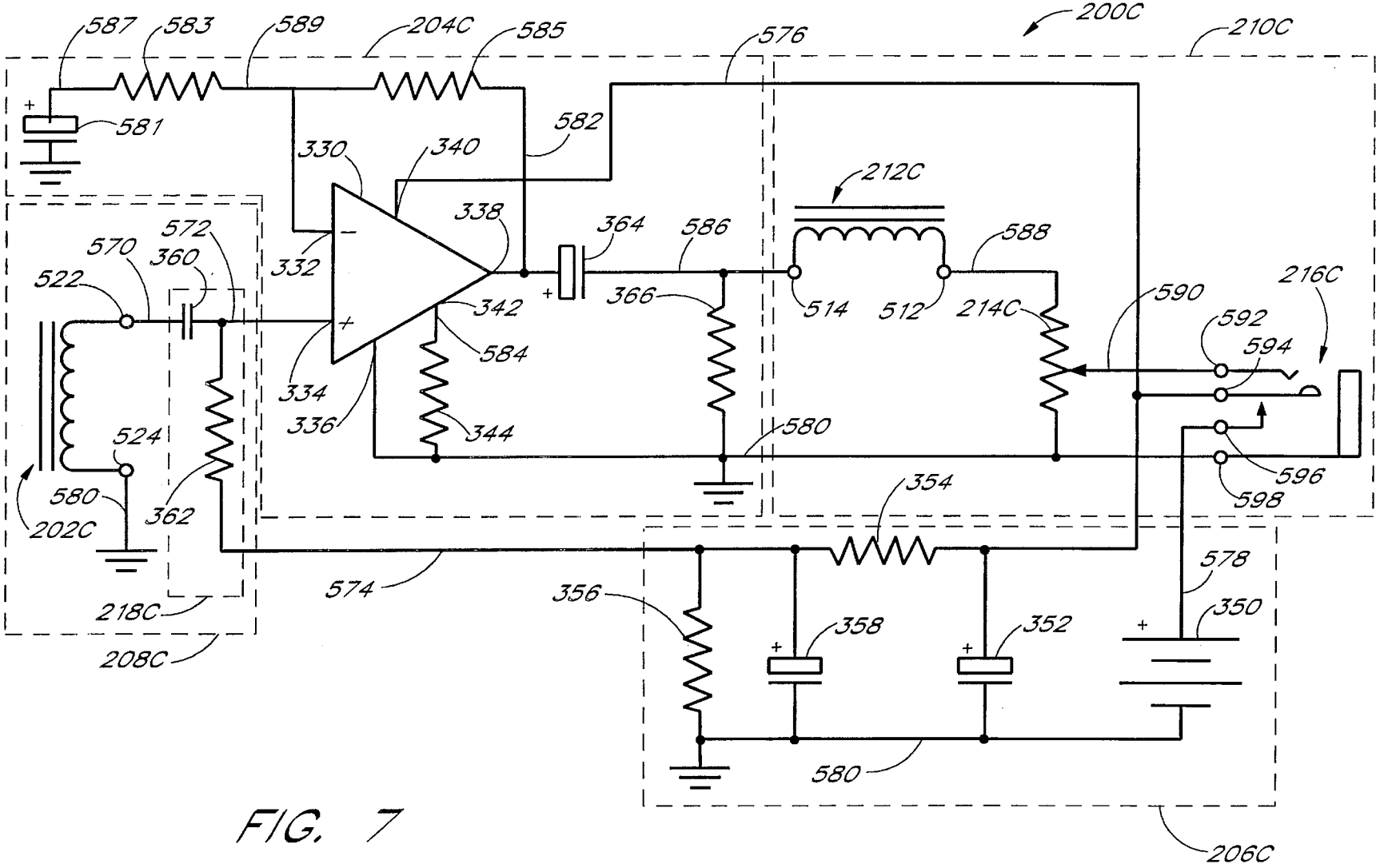
FIG. 7 is a schematic diagram of a third preferred embodiment of the musical pick-up device of the present invention.

FIG. 7 is a schematic diagram of a third preferred embodiment pick-up device 200C of the pick-up device 200. The third pick-up device 200C is substantially the same as the first embodiment pick-up device 200A, except that a third embodiment buffer 204C is different from the first embodiment buffer 204A. The third embodiment buffer 204C comprises the op amp 330, the programming resistor 344, a first gain resistor 583, a second gain resistor 585, and a grounding capacitor 581. The second gain resistor 585 preferably comprises a 10 kiloohm resistor, although the second gain resistor 585 may also have other values. The value of the first gain resistor 583 is dependent on the relative frequency responses of a third primary coil 212C and a third secondary coil 202C.

The configuration of the third buffer 204C implements a selectable gain noninverting amplifier. The value of the first gain resistor 583, in combination with the value of the second gain resistor 585, substantially determines the gain of the op amp 330, as is well known to a person of skill in the art. This configuration is generally advantageous in applications for which the third secondary coil 202C is not matched to the third primary coil 212C. If the third secondary coil 202C has a frequency response that is dissimilar from the frequency response of the third primary coil 212C, the noise components generated by the respective third coils 212C, 202C are different. For example, the noise component generated by the third primary coil 212C may have a greater magnitude than the noise component generated by the third secondary coil 202C. The gain of the third embodiment buffer 204C can be selected so that the noise component at the output of the third buffer 204C is amplified or attenuated to match the magnitude of the noise component from the third primary coil 212C. The amplified or attenuated noise component from the third secondary coil 202C is applied to the third primary coil 212C to more effectively cancel the noise component of the third primary coil 212C. Thus, the first gain resistor 583 is selected to achieve a gain that substantially optimizes noise cancellation.

Other than the amplification or attenuation of the noise component from the third secondary coil 202C, the operation of the third embodiment pick-up device 200C is substantially the same as the operation of the first embodiment pick-up device 200A. Also, the third pick-up device 200C achieves substantially the same advantages as the first pick-up device 200A.

FIG. 8 is a schematic diagram of a fourth preferred embodiment pick-up device 200D of the pick-up device 200.

The fourth embodiment pick-up device 200D is substantially the same as the first embodiment pick-up device 200A, except that a fourth embodiment cancellation circuit 208D is different from the first embodiment cancellation circuit 208A, and a fourth embodiment buffer 204D is different from the first embodiment buffer 204A.

The fourth cancellation circuit 208D comprises a fourth secondary coil 202D and a fourth load 218D. The fourth load 218D comprises the second coupling capacitor 360, a third gain resistor 683, and a variable gain resistor 691. The fourth secondary coil 202D is substantially the same as the secondary coil 202A, except that the fourth secondary coil 202D is wound in the same direction as a fourth primary coil 212D. The values of the third gain resistor 683 and the variable gain resistor 691 are selected to substantially match the frequency response of the fourth secondary coil 202D to the frequency response of the fourth primary coil 212D.

The fourth buffer 204D comprises the op amp 330, the programming resistor 344, the third gain resistor 683, a fourth gain resistor 685, and the variable gain resistor 691. The third gain resistor 683 and the fourth gain resistor 685 preferably comprise 150 kiloohm resistors, although other values can also be used. The variable gain resistor 691 preferably comprises a 100 kiloohm variable resistor, although, again, other values can be used.

The configuration of the fourth buffer 204D implements a selectable gain inverting amplifier. The resistance value of the variable gain resistor 691, along with the values of the third and fourth gain resistors 683 and 685, substantially determines the gain of the op amp 330, as is well known to a person of skill in the art. Again, this configuration is generally advantageous in applications for which the fourth secondary coil 202D is not matched to the fourth primary coil 212D. Also, the fourth preferred embodiment is used when the fourth secondary coil 202D is wound in the same direction as the fourth primary coil 212D. The inversion of the noise component from the fourth secondary coil 202D by the fourth buffer 204D causes the cancellation between the noise components from the two fourth coils 212D, 202D. Again, the variable gain resistor 691 is adjusted to achieve a gain that substantially optimizes noise cancellation.

A person of skill in the art will understand that the variable gain resistor 691, the third gain resistor 683, and the fourth gain resistor 685 in the inverting amplifier circuit of FIG. 8 can be replaced by the first gain resistor 583 and the second gain resistor 585 of FIG. 7. Also, the first gain resistor 583 and the second gain resistor 585 in the noninverting amplifier circuit of FIG. 7 can be replaced by the variable gain resistor 691, the third gain resistor 683, and the fourth gain resistor 685 of FIG. 8.

Other than the amplification or attenuation of the noise component from the fourth secondary coil 202D and the inverting action of the fourth buffer 204D, the operation of the fourth embodiment pick-up device 200D is substantially the same as the operation of the first embodiment pick-up device 200A. Also, the fourth embodiment pick-up device 200D achieves substantially the same advantages as the first pick-up device 200A.

Figure 9:
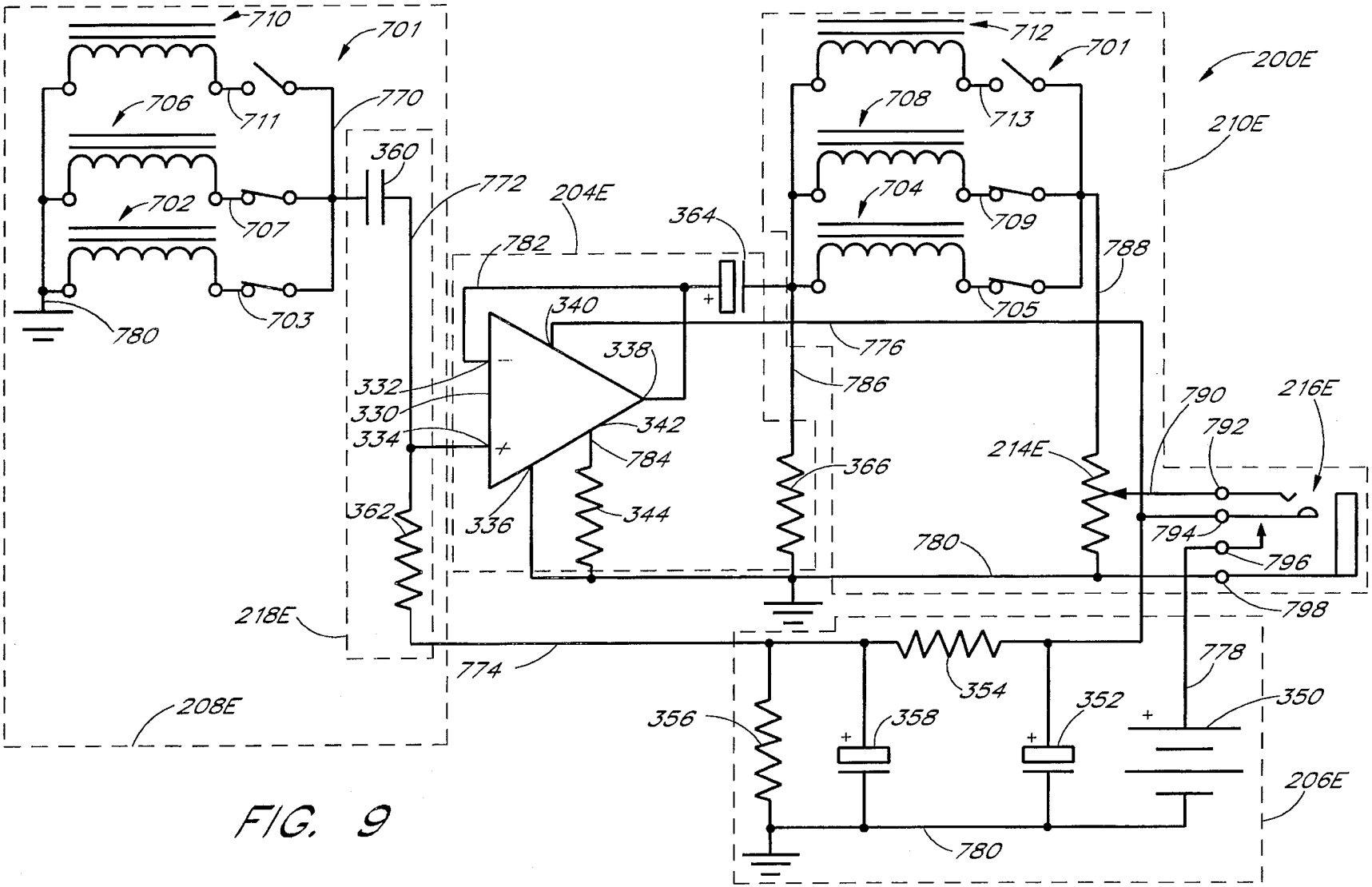
FIG. 9 is a schematic diagram of a fifth preferred embodiment of the musical pick-up device of the present invention.

FIG. 9 is a schematic diagram of a fifth preferred embodiment pick-up device 200E of the pick-up device 200. The fifth embodiment pick-up device 200E is substantially the same as the first embodiment pick-up device 200A, except that a fifth embodiment cancellation circuit 208E is different from the first embodiment cancellation circuit 208A, and a fifth embodiment primary circuit 210E is different from the first embodiment primary circuit 210A.

The fifth cancellation circuit 208E comprises a fifth secondary coil 702, a sixth secondary coil 706, a seventh secondary coil 710, a switch assembly 701, the second coupling capacitor 360, and the load resistor 362.

The fifth primary circuit 210E comprises a fifth primary coil 704, a sixth primary coil 708, a seventh primary coil 712, the switch assembly 701, a fifth volume control 214E, a fifth audio jack 216E, and the op amp load resistor 366.

The fifth secondary coil 702 is preferably matched to the fifth primary coil 704, to form a fifth pair of matched primary and secondary coils. The sixth secondary coil 706 is preferably matched to the sixth primary coil 708, to form a sixth pair of matched primary and secondary coils. The seventh secondary coil 710 is preferably matched to the seventh primary coil 712, to form a seventh pair of matched primary and secondary coils. The switch assembly 701 selects pairs of matched primary and secondary coils for operation. When a secondary coil 702, 706, 710 is selected for operation, a terminal of the secondary coil 702, 706, 710 is connected to a fifth hum signal line 770 for communication of a noise component generated by the selected secondary coil 702, 706, 710. When a primary coil 704, 708, 712 is selected for operation, a terminal of the primary coil 704, 708, 712 is connected to a fifth audio signal line 788 for communication of an audio signal generated by the selected primary coil 704, 708, 712. Anytime that one coil in a matched pair is selected, the other coil in the matched pair is preferably also selected. For example, if the sixth primary coil 708 is selected, the sixth secondary coil 706 is automatically selected. Also, any combination of matched primary and secondary coils can be selected. Thus, for example, any single pair of matched coils can be selected, or any two pairs of matched coils can be selected simultaneously, or all three pairs of matched coils can be selected simultaneously. When multiple pairs of matched coils are selected simultaneously, the signals generated by the selected secondary coils 702, 706, 710 are summed at the fifth hum signal line 770, and the signals generated by the selected primary coils 704, 708, 712 are summed at the fifth audio signal line 788. The three sets of matched coils may have different frequency responses from one another so that they produce different tones. Also, the three sets of matched coils may be placed at different locations to also produce different tones.

Other than the selection between multiple pairs of matched coils and the summing of audio signals generated by selected coils, the operation of the fifth embodiment pick-up device 200E is substantially the same as the operation of the first embodiment pick-up device 200A. Also, the fifth pick-up device 200E achieves substantially the same advantages as the first pick-up device 200A.

A person playing a musical instrument comprising a pickup circuit 200 of the present invention need not take any special action to benefit from the advantages of the present invention. Merely inserting an audio plug into the audio jack 216 and ensuring that the power supply 206 can provide sufficient electrical power renders the pickup circuit 200 operational.

Although the present invention has been described above in connection with particular embodiments, it should be understood that the descriptions of the embodiments are illustrative of the invention and are not intended to be limiting. Various modifications and applications may occur to those skilled in the art without departing from the true spirit and scope of the invention as defined in the appended claims.

What is claimed is:

1. A pickup circuit for an electric musical instrument having one or more strings, said pickup circuit comprising:

a first coil, said first coil responsive to the vibration of one or more of the strings to produce a first electronic signal, said first coil further responsive to one or more stimuli in addition to the vibration of said strings;

a second coil, said second coil responsive to one or more of the additional stimuli to produce a second electronic signal, said second signal combining with said first signal; and an isolation circuit connected between said second coil and said first coil and configured to isolate the first and second coil and combine the first and second signals to remove the portion of the first signal responsive to said one or more stimuli.

2. The pickup circuit of claim 1, wherein said isolation circuit comprises a buffer.

3. The pickup circuit of claim 1, additionally comprising a first load circuit, said first load circuit connected to said first coil, said first load circuit providing an impedance for the first coil that optimizes the frequency response of said first coil.

4. The pickup circuit of claim 1, additionally comprising a second load circuit, said second load circuit being connected to said second coil, said second load circuit providing an impedance for the second coil that causes the frequency response of said second coil to substantially match the frequency response of said first coil.

5. A pickup circuit for an electric musical instrument having one or more strings, said pickup circuit comprising:

an output terminal;

a first coil, said first coil positioned to sense the vibration of one or more of the strings, said first coil responsive to the vibration of one or more of the strings to produce a first electronic signal in response thereto, said first coil also responsive to one or more stimuli in addition to the vibration of said strings such that said first electronic signal represents said vibration and said one or more stimuli, said first coil coupled to said output terminal and providing a second electronic signal to said output terminal; and a second coil, said second coil responsive to one or more of said additional stimuli to produce a third electronic signal, said third electronic signal representative of said one or more stimuli, said second coil being interfaced with said first coil so that the impedance of said second coil is isolated from said first coil, said first signal combining with said third signal to produce said second signal such that said second signal is exclusive of said one or more stimuli.

6. The pickup circuit of claim 5, wherein said first coil drives said output terminal through a variable resistor.

7. A pickup circuit for an electric musical instrument having one or more strings, said pickup circuit comprising:

a first circuit, said first circuit comprising:

a first coil, said first coil responsive to the vibration of one or more of the strings to produce a first electronic signal, said first coil further responsive to one or more electromagnetic fields in addition to fields caused by the vibration of the one or more strings;

one or more first electronic impedance components coupled to said first coil, said first electronic impedance components having impedances selected to optimize the frequency response of said first coil;

an isolation circuit; and a second circuit coupled via said isolation circuit to said first circuit, said isolation circuit configured to isolate said first circuit from said second circuit, said second circuit comprising:

a second coil, said second coil responsive to said one or more electromagnetic fields to produce a second electronic signal, said second signal being combined with said first signal via said isolation circuit; and one or more second electronic impedance components, said second electronic impedance components having impedances selected to substantially match the frequency response of said second coil to the frequency response of said first coil.

8. The pickup circuit of claim 7, wherein said isolation circuit comprises a buffer.

9. The pickup circuit of claim 8, wherein said one or more first electronic impedance components comprise a variable resistor having a resistance of between 1 kiloohm and 1 megaohm.

10. The pickup circuit of claim 8, wherein said one or more second electronic impedance components comprise a resistor having a resistance of between 1 kiloohm and 1 megaohm.

11. The pickup circuit of claim 8, wherein said second coil is substantially matched to said first coil.

12. The pickup circuit of claim 8 additionally comprising:

a third coil, said third coil responsive to the vibration of one or more of the strings to produce a third electronic signal, said third coil also responsive to the one or more electromagnetic fields;

a fourth coil, said fourth coil responsive to one or more of said electromagnetic fields to produce a fourth electronic signal; and a switch, said switch selecting one or more signals of said first signal and said third signal for connection via said isolation circuit, said first signal combining with said third signal when both of said first and said third signals are selected, said switch also selecting one or more signals of said second signal and said fourth signal for connection via said isolation circuit, said selected one or more signals of said second signal and said fourth signal combining with said selected one or more signals of said first signal and said third signal.

13. The pickup circuit of claim 12, wherein said fourth coil is substantially matched to said third coil.

14. The pickup circuit of claim 12, wherein said switch automatically selects said second signal when said first signal is selected, and wherein said switch automatically selects said fourth signal when said third signal is selected.

15. A pickup circuit for an electric musical instrument having one or more strings, said pickup circuit comprising:

a first coil, said first coil responsive to the vibration of one or more of the strings to produce a first electronic signal representative of said vibration, said first coil also responsive to one or more electromagnetic fields;

a second coil, said second coil responsive to one or more of said electromagnetic fields to produce a second electronic signal; and a buffer, said second electronic signal coupled to an input of said buffer, said buffer responsive to said second electronic signal to produce a buffered signal at an output of said buffer, said buffer connected to combine said first signal and said buffered signal.

16. The pickup circuit of claim 15, wherein said buffer comprises an operational amplifier.

17. The pickup circuit of claim 15, wherein said buffer comprises an operational amplifier connected in a voltage follower configuration.

18. The pickup circuit of claim 15, wherein said buffer comprises an operational amplifier connected in a selectable gain noninverting amplifier configuration.

19. The pickup circuit of claim 15, wherein said buffer comprises an operational amplifier connected in a selectable gain inverting amplifier configuration.

20. The pickup circuit of claim 15, wherein said buffer comprises a transistor.

21. The pickup circuit of claim 15, wherein said second coil is selected to have a frequency response that is substantially similar to the frequency response of said first coil.

22. The pickup circuit of claim 15, wherein said second coil is also responsive to the vibration of one or more of the strings for producing said second signal.

23. A pickup circuit for an electric musical instrument having one or more strings, said pickup circuit comprising:

a first coil, said first coil responsive to the vibration of one or more of the strings to produce a first electronic signal, said first coil also responsive to one or more electromagnetic fields to produce noise in said first signal;

a second coil, said second coil responsive to one or more of said electromagnetic fields to produce a second electronic signal representative of said noise;

means for isolating said second coil from said first coil; and means for combining said second signal with said first signal for noise cancellation.

24. The pickup circuit of claim 23, additionally comprising a first load circuit, said first load circuit being connected to said first coil, said first load circuit providing an impedance that optimizes the frequency response of said first coil.

25. The pickup circuit of claim 24, additionally comprising a second load circuit, said second load circuit being connected to said second coil, said second load circuit providing an impedance that causes the frequency response of said second coil to substantially match the frequency response of said first coil.

26. A pickup circuit for a musical instrument having one or more strings, said pickup circuit comprising:

a first coil, said first coil responsive to the vibration of one or more of the strings and responsive to one or more electromagnetic stimuli in addition to the vibration of said strings to produce a first electronic signal, indicative of the vibration of said one or more strings and the one or more electromagnetic stimuli;

a second coil, said second coil responsive to said one or more electromagnetic stimuli to produce a second electronic signal indicative of said one or more electromagnetic stimuli, said second coil positioned to have minimal response to the vibration of said one or more strings; and an isolation circuit connected between said second coil and said first coil and configured to isolate the first and second coils and to combine the first and second signals to remove the portion of the first electronic signal responsive to said one or more stimuli.

27. The pickup circuit of claim 26, wherein said isolation circuit comprises a buffer.

28. The pickup circuit of claim 26, additionally comprising a first load circuit, said first load circuit connected to said first coil, said first load circuit providing an impedance for the first coil that optimizes the frequency response of said first coil.

29. The pickup circuit of claim 26, additionally comprising a second load circuit, said second load circuit being connected to said second coil, said second load circuit providing an impedance for the second coil that causes the frequency response of said second coil to substantially match the frequency response of said first coil.

30. The pickup of claim 26, wherein said isolation circuit is an active circuit, said pickup having a power source for said isolation circuit.

31. The pickup of claim 26, wherein said first coil is positioned beneath said one or more strings, and said second coil is positioned within said instrument away from directly beneath said one or more strings.

32. The pickup of claim 26, wherein said first coil is positioned beneath said one ore more strings, and said second coil positioned in proximity to said first coil such that the response to said one or more electromagnetic stimuli is substantially the same for the first coil and the second coil.

* * * * *